US008778052B2

(12) United States Patent
Dam et al.

(10) Patent No.: US 8,778,052 B2
(45) Date of Patent: Jul. 15, 2014

(54) METHOD OF PRODUCING A COMBINED GASEOUS HYDROCARBON COMPONENT STREAM AND LIQUID HYDROCARBON COMPONENT STREAMS, AND AN APPARATUS THEREFOR

(75) Inventors: Willem Dam, The Hague (NL); Dirk Willem Van Der Mast, The Hague (NL); Johan Jan Barend Pek, The Hague (NL)

(73) Assignee: Shell Oil Company, Houston, TX (US)

( * ) Notice: Subject to any disclaimer, the term of this patent is extended or adjusted under 35 U.S.C. 154(b) by 209 days.

(21) Appl. No.: 13/375,237

(22) PCT Filed: May 31, 2010

(86) PCT No.: PCT/EP2010/057513

§ 371 (c)(1), (2), (4) Date: Nov. 30, 2011

(87) PCT Pub. No.: WO2010/139652

PCT Pub. Date: Dec. 9, 2010

(65) Prior Publication Data

US 2012/0118008 A1 May 17, 2012

(30) Foreign Application Priority Data

Jun. 2, 2009 (EP) ..... 09161688

(51) Int. Cl.
*B01D 19/00* (2006.01)
*E21B 43/36* (2006.01)

(52) U.S. Cl.
CPC ..... *E21B 43/36* (2013.01)
USPC ..... 95/247; 95/258; 95/266; 96/193; 96/201

(58) Field of Classification Search
USPC ..... 95/247, 258, 266; 96/193, 201
See application file for complete search history.

(56) References Cited

U.S. PATENT DOCUMENTS

| | | | | |
|---|---|---|---|---|
| 2,937,140 | A * | 5/1960 | Stinson | 208/340 |
| 2,970,107 | A * | 1/1961 | Gilmore | 208/361 |
| 4,778,443 | A * | 10/1988 | Sands et al. | 494/31 |
| 6,905,605 | B2 | 6/2005 | Klomp | 210/698 |
| 2008/0190291 | A1 | 8/2008 | Krehbiel et al. | 95/241 |

FOREIGN PATENT DOCUMENTS

| | | | |
|---|---|---|---|
| EP | 0526929 | 7/1992 | F21B 37/06 |
| GB | 2186283 | 8/1987 | C10G 501/504 |
| GB | 2301838 | 12/1996 | C10L 1/32 |

(Continued)

OTHER PUBLICATIONS

A. Corrigan et al. "Trials of Threshold Hydrate Inhibitors in the Ravenspurn to Cleeton Line," SPE Production & Facilities, Nov. 1996, pp. 250-255.

(Continued)

*Primary Examiner* — Duane Smith
*Assistant Examiner* — Douglas Theisen

(57) ABSTRACT

First and second multi-phase streams are processed in first and second trains that are structurally different from each other such that the first and second trains have different operating conditions. The first and second trains produce first and second gaseous hydrocarbon streams and first and second liquid hydrocarbon component streams. The first and second gaseous hydrocarbon streams are combined downstream of the first and second trains to provide a combined gaseous hydrocarbon component stream.

17 Claims, 4 Drawing Sheets

(56) References Cited

FOREIGN PATENT DOCUMENTS

| | | | | |
|---|---|---|---|---|
| RU | 1794178 | A3 | 2/1993 | |
| SU | 601535 | A1 | 4/1978 | |
| WO | WO9817941 | | 4/1998 | ..... F17C 11/00 |
| WO | WO2007060228 | A1 | 5/2007 | |

OTHER PUBLICATIONS

C.B. Argo et al. "Commerical Deployment of Low-Dosage hydrate Inhibitors in a Southern North Sea 69 km Wet-Gas Subsea Pipeline," SPE Prod. & Facilities vol. 15, No. 2, May 2000, pp. 130-134.

"Ormen Lange Subsea Production System", Journal of Petroleum Technology (Aug. 2007); pp. 59-61.

* cited by examiner

METHOD OF PRODUCING A COMBINED GASEOUS HYDROCARBON COMPONENT STREAM AND LIQUID HYDROCARBON COMPONENT STREAMS, AND AN APPARATUS THEREFOR

CROSS-REFERENCE TO EARLIER APPLICATIONS

The present application is a national stage application of International application No. PCT/EP2010/057513, filed 31 May 2010, which claims priority of EP09161688.8 filed in the European patent office on 2 Jun. 2009.

FIELD OF THE INVENTION

The present invention relates to a method of producing a combined gaseous hydrocarbon stream and one or more liquid hydrocarbon component streams from at least two multi-phase hydrocarbon streams, and an apparatus therefor.

BACKGROUND OF THE INVENTION

In the context of the present application, a multi-phase stream comprises at least a co-existing vapour phase and a liquid phase, and optionally also a co-existing solid phase.

Such multi-phase streams may be produced from hydrocarbon wells, such as natural gas wells, in the form of a multi-phase hydrocarbon stream. The multi-phase hydrocarbon stream may comprise various components, including a variety of hydrocarbons, water, $CO_2$, sulphides such as $H_2S$ and other elements or compounds.

Conventionally, multi-phase hydrocarbon streams may be carried over large distances from one or more hydrocarbon wells in a hydrocarbon reservoir to the apparatus which receives and processes the multi-phase streams. This can occur because, for instance the hydrocarbon wells are located off-shore and a pipeline is necessary to transport the multi-phase hydrocarbon stream to an on-shore processing facility.

Producing wells, either in the same hydrocarbon reservoir or from a different hydrocarbon reservoir, may provide multi-phase flows of significantly different characteristics in terms of compositions and properties, such as temperature and pressure. If such multi-phase flows have to be transported over a large distance before component separation can be carried out, economic limitations may require that such multi-phase flows of differing composition are carried in the same pipeline in a combined flow. Component separation must then be carried out on the combined flow. The separation facility will have one or more identical separation trains running in parallel to treat the combined flow.

Where large distances are involved between the well(s) and the separation facility, different multi-phase streams from different sets of hydrocarbon wells, which may be in the same or different hydrocarbon reservoirs, may be carried together in the same pipeline in order to reduce costs to render the hydrocarbon extraction economically viable. The use of a single long distance pipeline requires that the same method or methods used to ensure adequate flow of the multi-phase stream in the pipeline must be applied to all of the different multi-phase streams carried in the pipeline, if any steps are taken at all. These methods are known in the art as "flow assurance methods". For instance, a pipeline can be insulated, heated or have hydrate inhibitor added to the multi-phase streams which it carries to minimise hydrate formation during transfer to the processing facility. The Ormen Lange field in the Norwegian Sea utilises such a flow assurance system, as described in the Journal of Petroleum Technology, August 2007, pages 51-61, in which a hydrate inhibitor is added to the multi-phase stream.

In addition, some hydrocarbon reservoirs can provide multi-phase hydrocarbon streams from different wells at different pressures. In such instances the pressure of the higher pressure multi-phase stream is normally reduced so that it can be added to the lower pressure multi-phase stream and transported along a single pipeline. This normally necessitates the re-pressurisation of at least the gaseous component of the multi-phase stream at the processing facility utilising a depletion compressor.

SUMMARY OF THE INVENTION

In a first aspect, the present invention provides a method of producing a combined gaseous hydrocarbon component stream and liquid hydrocarbon component streams from at least two multi-phase hydrocarbon streams, comprising at least the steps of:

(1) employing a first train comprising a first pipeline for the first multi-phase hydrocarbon stream from one or more first hydrocarbon wells, a first inlet separator to separate the first multi-phase hydrocarbon stream to provide a first gaseous hydrocarbon component stream and a first liquid hydrocarbon component stream and a first low pressure separator to separate the first liquid hydrocarbon component stream to provide a first condensate component feed stream and a first overhead gaseous hydrocarbon stream;

(2) employing a second train comprising a second pipeline for the second multi-phase hydrocarbon stream from one or more second hydrocarbon wells, a second inlet separator to separate the second multi-phase hydrocarbon stream to provide a second gaseous hydrocarbon component stream and a second liquid hydrocarbon component stream and a second low pressure separator to separate the second liquid hydrocarbon component stream to provide a second condensate component feed stream and a second overhead gaseous hydrocarbon stream; and (3) combining the second gaseous hydrocarbon stream downstream of the second train with the first gaseous hydrocarbon stream downstream of the first train, after optional compression in a depletion compressor, to provide a combined gaseous hydrocarbon component stream; wherein first train is structurally different from the second train such that the first and second trains have different operating conditions.

In a second aspect, the present invention provides an apparatus for producing combined gaseous hydrocarbon and liquid hydrocarbon component streams from at least two multi-phase hydrocarbon streams, said apparatus comprising:

- a first train comprising a first pipeline, for a first multi-phase hydrocarbon stream connected to a first inlet of a first inlet separator, said first inlet separator having a first outlet for a first gaseous hydrocarbon component stream and a second outlet for a first liquid hydrocarbon component stream, said second outlet connected to the first inlet of a first low pressure separator, said first low pressure separator having a first outlet for a first condensate component feed stream, a second outlet for a first overhead gaseous hydrocarbon stream; and
- a second train comprising a second pipeline for a second multi-phase hydrocarbon stream connected to the first inlet of a second inlet separator, said second inlet separator having a first outlet for a second gaseous hydrocarbon component stream and a second outlet for a second liquid hydrocarbon component stream, said second outlet connected to the first inlet of a second low pressure separator, said second low pressure separator having a first outlet for a second condensate component feed stream, a second outlet for a second overhead gaseous hydrocarbon stream; and wherein the first outlet of the second inlet separator and the first outlet of the first inlet separator are fluidly connected downstream of the first and second trains to provide a combined gaseous hydrocarbon component stream line and wherein the first train is structurally different from the second train such that the first and second trains during operation have different operating conditions.

BRIEF DESCRIPTION OF THE DRAWINGS

Embodiments of the present invention will now be described by way of example only, and with reference to the accompanying non-limiting drawings in which.

For the purpose of this description, a single reference number will be assigned to a line as well as a stream carried in that line. The same reference numbers refer to similar components, streams or lines.

DETAILED DESCRIPTION OF THE INVENTION

Figure 1:
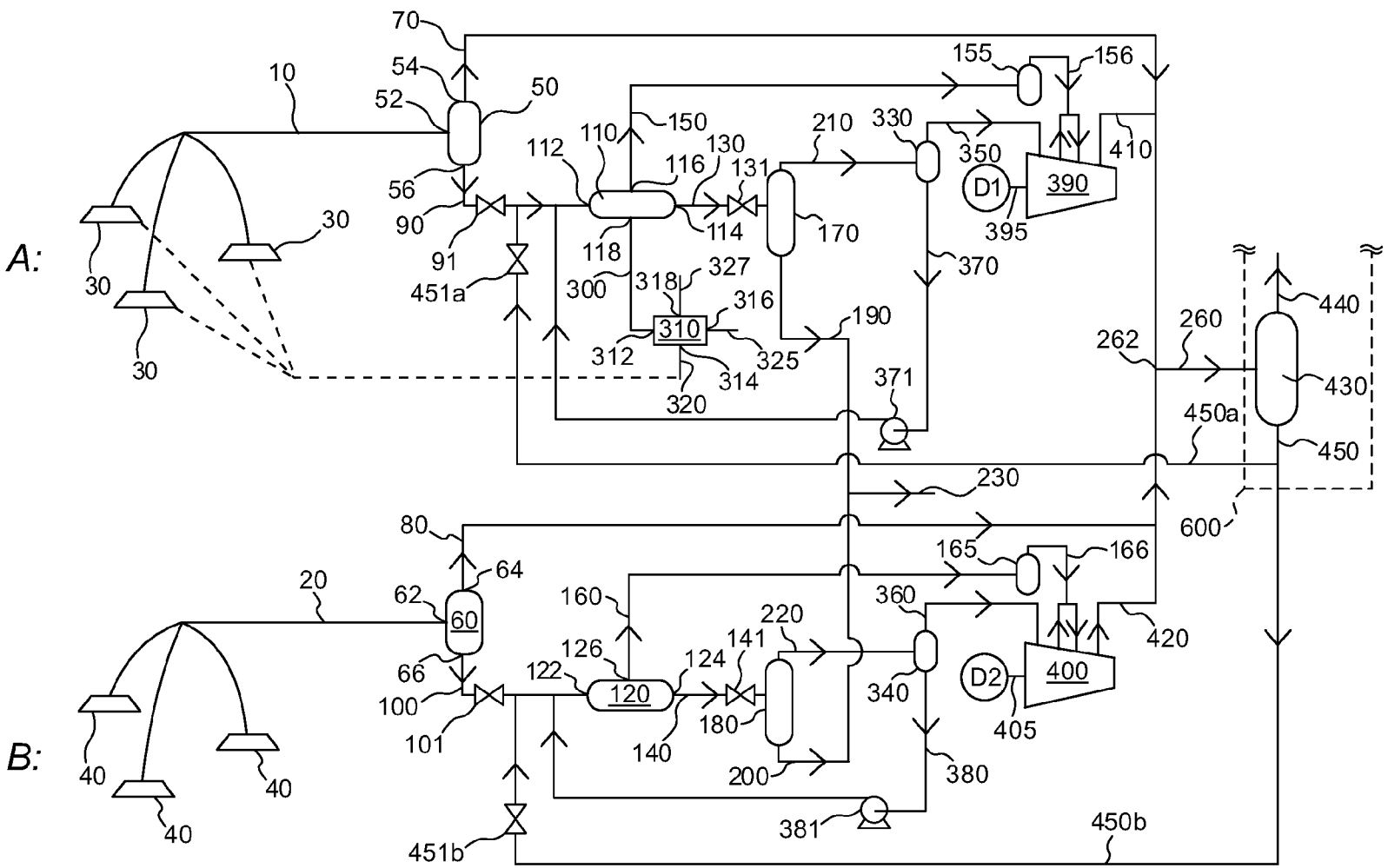
FIG. 1 shows a first process scheme according to an embodiment of the method and apparatus of the invention, in which the first multi-phase hydrocarbon stream comprises a hydrate inhibitor such that the first train comprises a regenerating unit for the hydrate inhibitor.

It is proposed to process first and second multi-phase streams in first and second trains that are structurally different from each other such that the first and second trains have different operating conditions. The first and second trains produce first and second gaseous hydrocarbon streams and first and second liquid hydrocarbon component streams. The first and second gaseous hydrocarbon streams are combined downstream of the first and second trains to provide a combined gaseous hydrocarbon component stream.

The different operating conditions of the first and second trains may be one or more of the group consisting of: operating pressure and flow assurance strategy. Different flow assurance strategies may comprise one or more of the group comprising: the presence of a hydrate inhibitor, the insulation of the pipeline and the heating of the pipeline. One or both of the insulation and heating of the pipeline will lead to a change in the operating temperature of the multi-phase hydrocarbon stream carried therein compared to a pipeline not having such insulation or heating.

An advantage of the proposed use of two trains is that differing multi-phase flows can be transported in separate pipelines and be handled with a train tailored for the specific requirements for each of the multi-phase flows. The requirements may particularly be different if the distance which the multi-phase flows are to be conveyed is not too great. This situation may occur where the separation facility is housed on an off-shore structure, such as a vessel or platform, which can be located closer to the well heads, reducing the length of the pipelines conveying the multi-phase streams.

Thus, the invention allows for the possibility of providing multiple pipelines with individual flow assurance methods, and then downstream of the trains to combine the gaseous hydrocarbon components streams for combined further processing, such as acid gas removal, dehydration, NGL extraction and liquefaction.

The provision of different trains can be particularly advantageous in those situations where one or both of the: one or more first hydrocarbon wells, and one or more second hydrocarbon wells, are relatively close to the processing apparatus, such as if the apparatus is situated on an off-shore vessel or platform. This allows multi-phase hydrocarbon streams having different properties to be conveyed and processed separately.

For instance, a high pressure and a low pressure multi-phase stream in separate trains can be transported in separate pipelines such that the higher pressure can be maintained. This is advantageous because the energy requirements of any further compression will be lower compared to the energy required to recompress a stream which had been decompressed and combined with the low pressure multi-phase stream in a single pipeline.

In addition, the provision of two structurally different trains allows individual flow assurance methods to be used on each train. Different flow assurance methods can be used on the different trains, or a flow assurance method can be used on one train and no flow assurance method can be used on another train.

For instance, a method of hydrate inhibition can be applied to one train and not another, or different methods of hydrate inhibition can be used on different trains. In this way, the optimal flow assurance method can be provided for a particular multi-phase stream.

The method and apparatus disclosed herein is particularly useful when carried out off-shore. For instance when the inlet separators and low pressure separators are provided on a floating vessel or platform.

As used herein, the term "train" defines the fluid route taken by a multi-phase hydrocarbon stream, through a pipeline from one or more hydrocarbon wells, through an inlet separator to provide a gaseous hydrocarbon component stream (which may be passed through a depletion compressor), and a liquid hydrocarbon component stream, the liquid hydrocarbon component stream being passed through a low pressure separator to provide a condensate component stream and a first overhead gaseous hydrocarbon stream. The fluid route of a given train may terminate when the gaseous hydrocarbon component stream is combined with a second gaseous hydrocarbon component stream from a different train to form a combined gaseous hydrocarbon component stream.

The present invention thus employs at least two trains each comprising a pipeline, an inlet separator and a low pressure separator, in which the two trains differ structurally. A train may further comprise additional units and equipment, such as side stream processing equipment including regeneration units for hydrate inhibitors and/or water treatment units.

In one embodiment, as will hereinbelow be further illustrated with reference to FIG. 1, it is proposed that the first train carries a first multi-phase hydrocarbon stream which comprises a hydrate inhibitor requiring regeneration in a regenerating unit, while the second train does not.

Some multi-phase hydrocarbon streams may be predisposed to gas hydrate formation because of their properties. Gas hydrates are crystalline water-based solids similar in structure to ice in which small non polar molecules, such as methane are trapped in cages formed of hydrogen bonded water molecules. The thermodynamic conditions which may result in gas hydrate formation are often found in pipelines carrying multi-phase hydrocarbon streams. If formed, gas hydrate crystals may agglomerate and reduce the multi-phase flow, and in severe cases, entirely block the pipeline. Once formed, gas hydrates can be decomposed by an increase in temperature and/or a decrease in pressure. However, such decomposition is a kinetically slow process and so it is preferred to take steps to mitigate against gas hydrate formation. Such steps are known as flow assurance methods.

Such flow assurance methods include avoiding operational conditions which may cause the formation of gas hydrates. For instance, if the one or more hydrocarbon wells are located on the sea bed, at least a part of the pipeline will be undersea. If the multi-phase hydrocarbon stream is predisposed to gas hydrate formation, the sea water can cool the multi-phase hydrocarbon stream in the undersea portion of the pipeline and cause the formation of gas hydrates, which can adhere to the inner surface of the first pipeline reducing the flow of the multi-phase stream.

Gas hydrate formation can be minimised by insulating the pipeline to prevent the cooling of the multi-phase stream to gas hydrate forming temperatures. Additionally and/or alternatively, the pipeline can be provided with external heating to prevent the temperature of the multi-phase hydrocarbon stream falling to gas hydrate forming temperatures. Still further additionally and/or alternatively, the multi-phase hydrocarbon stream can be provided with a hydrate inhibitor before or at the time it is passed to the pipeline.

Hydrate inhibitors are chemicals which inhibit the formation of gas hydrates. This inhibition may occur by shifting the gas hydrate forming equilibrium reaction away from hydrate formation at lower temperatures and higher pressures (thermodynamic inhibitors), inhibit the gas hydrate formation reaction so that the time taken for gas hydrates to form is increased (kinetic inhibitors) and/or prevent the agglomeration of any gas hydrates formed (anti-agglomerants).

Examples of thermodynamic inhibitors are alcohols, such as methanol, and or glycols, such as monoethylene glycol (MEG), diethylene glycol (DEG) and triethylene glycol (TEG). MEG is preferred for those situations in which the temperature of the multi-phase hydrocarbon stream may be reduced to −10° C. or less because of its high viscosity at low temperatures.

Examples of kinetic inhibitors include polymers and copolymers, such as the threshold growth inhibitors disclosed in the Soc. Petroleum engineers, C. Argo, 37255, 1997 and A. Corrigan, 30696, 1997.

Examples of anti-agglomerants include Zwitterionic surfactants, such as ammonium and carboxylic acid group-containing species. Further examples of anti-agglomerants are disclosed in EP 0 526 929 and U.S. Pat. No. 6,905,605.

Turning now to FIG. 1, there is shown a schematic diagram of a process scheme including a first train A and a second train B. The first train A comprises a first multi-phase hydrocarbon stream 10, in a first pipeline. The first pipeline 10 has at least one upstream end. The at least one first upstream end of the first pipeline is connected to one or more first hydrocarbon wells 30, for instance via one or more first well-head manifolds. The one or more first hydrocarbon wells 30 may for example be the wells of a natural gas field.

The first multi-phase hydrocarbon stream 10 may comprise hydrocarbon gases, hydrocarbon liquids, water and solids including sand and trace amounts of corrosion products from the pipeline. For instance, the first multi-phase stream may be a natural gas stream, for example a stream transporting natural gas under high pressure from the one or more first hydrocarbon wells 30. The natural gas stream may contain a number of valuable liquid and gaseous components. The liquid components may comprise natural gas liquids (NGLs) such as methane, ethane, propane and butanes, and liquid condensate comprising C5+ hydrocarbons. The gaseous components may comprise predominantly methane (e.g. >80 mol %) with the remainder being ethane, nitrogen, carbon dioxide and other trace gasses. The liquid and gaseous components can be treated to provide natural gas liquids, natural gas, and liquefied natural gas.

In the embodiment of FIG. 1, the first multi-phase hydrocarbon stream 10 takes the form of a first hydrate inhibited multi-phase hydrocarbon stream which comprises a hydrate inhibitor. The hydrate inhibitor may be a glycol, such as MEG, which can be regenerated. The hydrate inhibitor is added to the first multi-phase stream before it enters the first pipeline 10, and for instance can be injected into the hydrocarbon reservoir or added at the one or more first hydrocarbon wells 30. The hydrate inhibitor can be provided as hydrate inhibitor component stream 320, which is discussed in greater detail below.

The first hydrate inhibited multi-phase hydrocarbon stream 10 is passed to the first inlet 52 of a first inlet separator 50, such as a gas/liquid separator, in a separation facility. The separation facility may be located either on or off-shore. In a preferred embodiment the separation facility is located off-shore, such as on a floating structure.

The first inlet separator 50 separates the first hydrate inhibited multi-phase hydrocarbon stream 10 into a first gaseous hydrocarbon component stream 70 at a first outlet 54, and a first liquid hydrocarbon component stream 90 at second outlet 56. The first liquid hydrocarbon component stream 90 comprises the hydrate inhibitor. In an optional embodiment, not shown in FIG. 1, one or both of the first gaseous hydrocarbon component stream 70 and/or the first liquid hydrocarbon component stream 90 can be heated or cooled using a heat exchanger, should it be necessary to raise or lower the temperature of one or both of the streams.

A low pressure separator 110 is provided in the separation facility, which in the first train A of the embodiment as shown in FIG. 1 is a three phase separator.

The first liquid hydrocarbon component stream 90 is passed to the first inlet 112 of the first low pressure separator 110. A valve 91 may be provided in line 90 to lower the pressure of the first liquid hydrocarbon component stream 90 to the operating pressure of the low pressure separator 110. The low pressure separator 110 provides a first condensate component feed stream 130 at a first outlet 114, a first overhead gaseous hydrocarbon stream 150 at a second outlet 116, and a first spent hydrate inhibitor stream 300 at a third outlet 118.

The first spent hydrate inhibitor stream 300 can be passed to the first inlet 312 of a regenerating unit 310, which can separate the hydrate inhibitor from water, to provide a hydrate inhibitor component stream 320 at a first outlet 314, a regeneration unit water stream 325 at a second outlet 316 and a brine stream 327 at third outlet 318. The hydrate inhibitor component stream 320 may be, for example, a lean glycol stream such as a lean MEG stream. The brine stream 327 may comprise solids and salts. The hydrate inhibitor component stream 320 can be passed to the one or more first hydrocarbon wells 30, for reinjection to provide the first hydrate-inhibited multi-phase hydrocarbon stream 10.

The presence of the regeneration unit 310 is economically advantageous when the hydrate inhibitor is a glycol such as MEG, DEG and/or TEG because it allows the regeneration of the hydrate inhibitor for re-use. In those cases where the hydrate inhibitor is an alcohol, such as methanol, hydrate inhibitor regeneration may not be so favourable from an economical standpoint. This could be examined on a case by case basis.

In an optional embodiment not shown in FIG. 1, the first inlet separator 50 itself may be a three phase separator. A hydrate inhibitor comprising liquid stream, such as a rich MEG stream, can then be passed from a third outlet of the first inlet separator 50 directly to the regenerating unit 310, as a first regenerating unit feed stream. Alternatively, the hydrate inhibitor comprising liquid stream may be an aqueous stream which can be passed to a water treatment unit. These line-ups may be useful for processing hydrocarbon slugs.

In a further optional embodiment not shown in FIG. 1, the regenerating unit 310 can be incorporated into the low pressure separator 110.

Returning to the first low pressure separator 110, the first condensate component feed stream 130 is passed to a first condensate stabiliser 170 via valve 131. A heat exchange step (not shown) may be performed to adjust the temperature to the desired operating temperature of the first condensate stabiliser 170. The first condensate stabiliser 170 provides a first condensate component stream 190 at or near the bottom of the stabiliser and a first condensate separated gaseous hydrocarbon stream 210.

The first condensate separated gaseous hydrocarbon stream 210 is passed to a first knock out drum 330, to separate any liquid components and provide a first compressor feed stream 350 as an overhead gaseous stream and a first low pressure separator recycle stream 370, at or near the bottom of the first knock out drum, which is returned to first low pressure separator 110, for instance by injection into first liquid hydrocarbon component stream 90. A pump 371 is provided to increase the pressure to allow for the return of the recycle stream 370 to the first low pressure separator 110.

The first compressor feed stream 350 is passed to a first compressor 390, driven by first compressor driver D1 via first shaft 395. In the present embodiment, the first compressor 390 is a multi-stage compressor. Alternatives are possible, such as two single stage compressors in series. The first compressor feed stream 350 is passed to the low pressure stage of first compressor 390 to provide first compressed stream 410. First compressed stream 410 can be injected into the first gaseous hydrocarbon component stream 70 from the first inlet separator 50.

Returning to the first low pressure separator 110, the first overhead gaseous hydrocarbon stream 150 can be passed to a second knock out drum 155, to separate any liquid components and provide a first intermediate pressure feed stream 156 as an overhead gaseous stream. The first intermediate pressure feed stream 156 is passed to the intermediate pressure stage of the first compressor 390. A bottoms stream (not shown) from the second knock out drum 155 can be returned to first liquid hydrocarbon component stream 90.

FIG. 1 further shows the second train B, which is structurally different from the first train A such that that the first and second trains (A, B) have different operating conditions. Similar to the first train A, the second train B comprises a second multi-phase hydrocarbon stream 20, in a second pipeline 20. The second pipeline 20 has at least one upstream end. The at least one upstream end of the second pipeline is connected to one or more second hydrocarbon wells 40, for instance via one or more first well-head manifolds. The one or more second hydrocarbon wells 40 may for example be the wells of a natural gas field. The second hydrocarbon wells 40 may be in the same or different hydrocarbon reservoir than the one or more first hydrocarbon wells 30.

However, the second multi-phase hydrocarbon stream 20 has different a characteristic compared to the first multi-phase hydrocarbon stream 10, such that the second multi-phase hydrocarbon stream 20 is not injected with a hydrate inhibitor. The second train B does not therefore require a regeneration unit for the separation and removal of a hydrate inhibitor, and therefore differs structurally from the first train A.

The second multi-phase hydrocarbon stream 20 is passed to the first inlet 62 of a second inlet separator 60, such as a gas/liquid separator, in the same separation facility as the first inlet separator 50.

The second inlet separator 60 separates the second multi-phase hydrocarbon stream 20 into a second gaseous hydrocarbon component stream 80 at a first outlet 64, and a second liquid hydrocarbon component stream 100 at second outlet 66. In an optional embodiment not shown in FIG. 1, the second gaseous hydrocarbon component stream 80 and/or second liquid component stream 100 can be heated or cooled in a heat exchanger, if it is necessary to raise or lower the temperature of these streams.

The second liquid hydrocarbon component stream 100 is passed via valve 101 to the first inlet 122 of a second low pressure separator 120. The second low pressure separator 120 provides a second condensate component feed stream 140 at a first outlet 124 and a second overhead gaseous hydrocarbon stream 160 at a second outlet 126.

The second condensate component feed stream 140 can be optionally cooled (not shown) and passed to a second condensate stabiliser 180 via valve 141 and optional heat exchanger (not shown). The second condensate stabiliser 180 provides a second condensate component stream 200 at or near the bottom of the stabiliser and a second condensate separated gaseous hydrocarbon stream 220. The second condensate component stream 200 can be combined with the first condensate component stream 190 from the first train A to provide a combined condensate component stream 230.

The second condensate separated gaseous hydrocarbon stream 220 is passed to a third knock out drum 340, to separate any liquid components and provide a second compressor feed stream 360 as an overhead gaseous stream and a second low pressure separator recycle stream 380, at or near the bottom of the third knock out drum, which is returned to second low pressure separator 120, with the aid of a second pump 381 and suitably via injection into second liquid hydrocarbon component stream 100.

The second compressor feed stream 360 is passed to a second compressor 400, driven by second compressor driver D2 via second shaft 405. Preferably the second compressor feed stream 360 is passed to a low pressure stage of the second compressor 400 to provide second compressed stream 420. Similar to the first compressor 390 in train A, the second compressor may be a multi-stage compressor as shown, or similar.

Returning to the second low pressure separator 120, the second overhead gaseous hydrocarbon stream 160 can be passed to a fourth knock out drum 165, to separate any liquid components and provide a second intermediate pressure feed stream 166 as an overhead gaseous stream. The second intermediate pressure feed stream 166 is passed to the intermediate pressure stage of the second compressor 400 to provide second compressed stream 420. Second compressed stream 420 can be injected into the second gaseous hydrocarbon component stream 80 from the second inlet separator 80.

Downstream of trains A and B, the second gaseous hydrocarbon component stream 80 is combined with the first gaseous hydrocarbon component stream 70 (from the first train A) at combiner 262, to provide a combined gaseous hydrocarbon component stream 260.

The combined gaseous hydrocarbon component stream 260 further processed in a gas processing plant 600, indicated in FIG. 1 as an open dashed box. The further processing of the combined gaseous hydrocarbon component stream 260 may, as shown, include passing the combined gaseous hydrocarbon component stream 260 to a feed separator 430, which can be a gas/liquid separator, to provide a feed gas stream 440 overhead and a feed separator bottoms stream 450. At least a portion of the feed separator bottoms stream 450 can be returned to one or both of first and second inlet separators 110, 120. For instance, as shown in FIG. 1, a portion, 450*a* of feed separator bottoms stream 450 may be injected into first liquid hydrocarbon component stream 90 via valve 451*a*. Similarly, a portion 450*b* of feed separator bottoms stream 450 can be injected into second liquid hydrocarbon component stream 100 via valve 451*b*.

In this way, the embodiment shown in FIG. 1 provides a combined gaseous hydrocarbon component stream 260, and combined condensate component stream 230 from first and second trains which differ structurally from each other. In particular, only the first train A requires the presence of a regeneration unit 310 for the hydrate inhibitor. The second train B will utilize a different (see for example train A of the embodiment of FIG. 2) or no flow assurance method.

Thus, with regard to the second aspect discussed above, the embodiment of FIG. 1 provides that said first pipeline 10 is for a first hydrate-inhibited multi-phase hydrocarbon stream 10, said first outlet 54 of the first inlet separator 50 is connected to the inlet 262 of a combined gaseous hydrocarbon component stream line 260, said inlet 262 also being connected to the first outlet 64 of the second inlet separator 60; said first low pressure separator 110 further comprises a third outlet 118 for a first spent hydrate inhibitor stream 300, said third outlet connected to the first inlet 312 of a hydrate inhibitor regenerating unit 310; said hydrate inhibitor regenerating unit 310 having a first outlet 314 for a hydrate inhibitor component stream 320; and wherein an outlet of said second low pressure separator 120 is not connected to a hydrate inhibitor regenerating unit.

Figure 2:
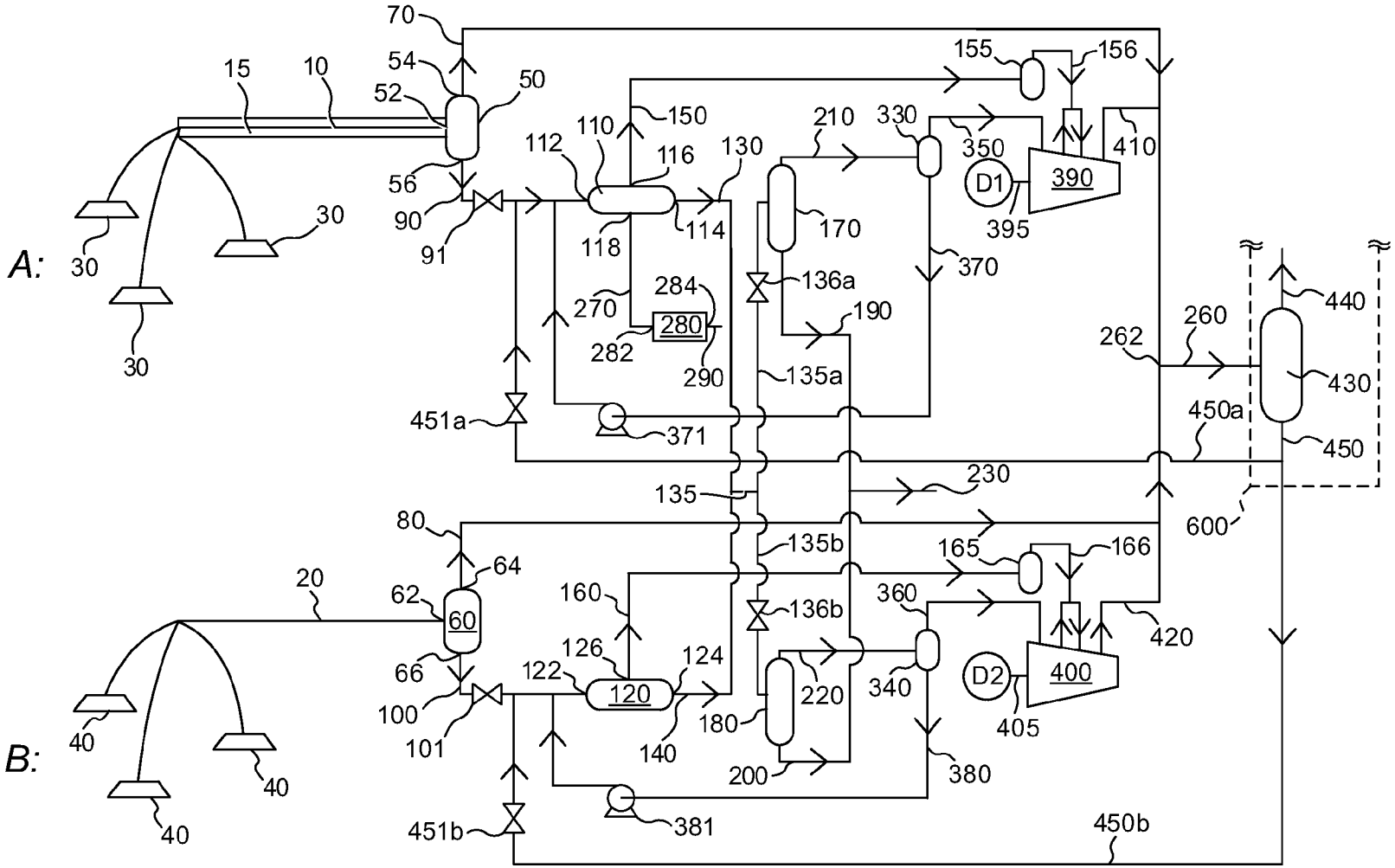
FIG. 2 shows a second process scheme according to a second embodiment of the method and apparatus of the invention, in which the first pipeline of the first train is heated or insulated to minimise hydrate formation.

FIG. 2 shows a second embodiment of the method and apparatus disclosed herein in which a different flow assurance method is used in the first train A, compared to second train B, and the embodiment of FIG. 1.

In particular, rather than the injection of a hydrate inhibitor into the first multi-phase hydrocarbon stream, the first pipeline 10 is provided with one or both of an insulating or heating jacket 15, at least in those portions where the first pipeline may be subjected to cooling which can result in gas hydrate formation in the first multi-phase hydrocarbon stream. For example, if the one or more first well heads 30 are undersea well heads, the first pipeline 10 may be a first insulated and/or heated pipeline in at least the deep sea potion of the pipeline.

The insulation and/or heating of the first pipeline 10 is sufficient to maintain the temperature of the first multi-phase hydrocarbon stream 10 above the gas hydrate formation temperature for this particular multi-phase composition. Thus, the first multi-phase hydrocarbon stream 10 will arrive at the first inlet separator 50 of the processing facility without appreciable gas hydrate formation.

The first train A is of a similar construction to the first train of the embodiment of FIG. 1, with the exception that the third outlet 118 of the first low pressure separator 110 provides a first water component stream 270. The first water component stream 270 is passed to the first inlet 282 of a water treatment unit 280, to separate water from the remaining, e.g. liquid hydrocarbon, components of the first water component stream 270 to provide a water stream 290 at first outlet 284.

The second train B is of similar construction as the second train B of FIG. 1, and will therefore not be described again except for the manner in which the second low pressure separator 120 is connected to the second stabiliser 180. Particularly, the embodiment of FIG. 2 shows a possible alternative line-up for the processing of the first and second condensate component feed streams 130, 140.

Rather than each condensate component feed stream 130, 140 being fed to its respective condensate stabiliser 170, 180, the first and second condensate component feed streams 130, 140 are first combined into a combined condensate component feed stream 135. Portions 135*a*, 135*b* of the combined condensate component feed stream 135 can then be passed to the first and/or second condensate stabilisers 170, 180 respectively, as desired, via respective valves 136*a*, 136*b*. The combining and subsequent redividing of the condensate component feeds streams allows the load of the first and second condensate component feed stream 130, 140 to be balanced between the two condensate stabilisers 170, 180, and even allows one of the stabilisers to be brought off-line for repair or maintenance without having to entirely stop condensate stabilisation in the separation facility.

In this way, the embodiment shown in FIG. 2 provides a combined gaseous hydrocarbon component stream 260, and combined condensate component stream 230 from first and second trains which differ structurally. In particular, only the first train A requires the presence of an insulating and/or heating jacket 15 on the first pipeline 10. The second train B will utilise a different, or no flow assurance method.

Thus, with regard to the second aspect discussed above, the embodiment of FIG. 2 provides that said first pipeline 10 is selected from one or both of the group comprising: a first insulated pipeline and a first heated pipeline and is for a first hydrate-inhibited multi-phase hydrocarbon stream 10; the first outlet 54 of the first inlet separator 50 is connected to a first inlet 262 of the combined gaseous hydrocarbon component stream line 260, said first inlet 262 also being connected to the first outlet 64 of the second inlet separator 60; the first low pressure separator 110 further comprises a third outlet 118 for a first water component stream 270, said third outlet connected to the first inlet 282 of a water treatment unit 280; said water treatment unit has a first outlet 284 for a water stream 290; and an outlet of said second low pressure separator 120 is not connected to a water treatment unit 280.

In an operation, the pressure in the first and second pipelines 10, 20 and the first and second inlet separators 50, 60 may typically be between 35 and 75 bara (reference to pressure throughout the specification will be in absolute pressure). The first and second low pressure separators 110, 120 may be operated at a pressure in the range of from 15 to 35 bara, typically at about 25 bara, and a temperature of typically in a range of from 35 to 70° C. The lower limit of this range may be 40° C. and/or the upper limit may be 60° C. In particular an extra safety margin in the lower limit is important, because at a temperature below 30° C. an emulsion may form which reduces the separation between the hydrocarbon and aqeous phases. A temperature above between 60 and 70° C. will adversely increase the size of the first and second compressors 390, 400.

The operating pressure of the first and second condensate stabilisers 170, 180 may be in the range of from 5 to 10 bara, depending on the operating temperature. Typically about 6 bara is suitable, with an operating temperature of between about 130 and 140° C. The pressure of the combined gaseous component hydrocarbon stream 260 may be a little bit, typically about 5 bar, lower than the pressure in the first and second pipelines 10, 20, e.g. in the range of from 50 to 70 bara, suitably about 65 bara. At this point, the temperature is usually about equal to ambient air temperature, e.g. 30° C.

Figure 3:
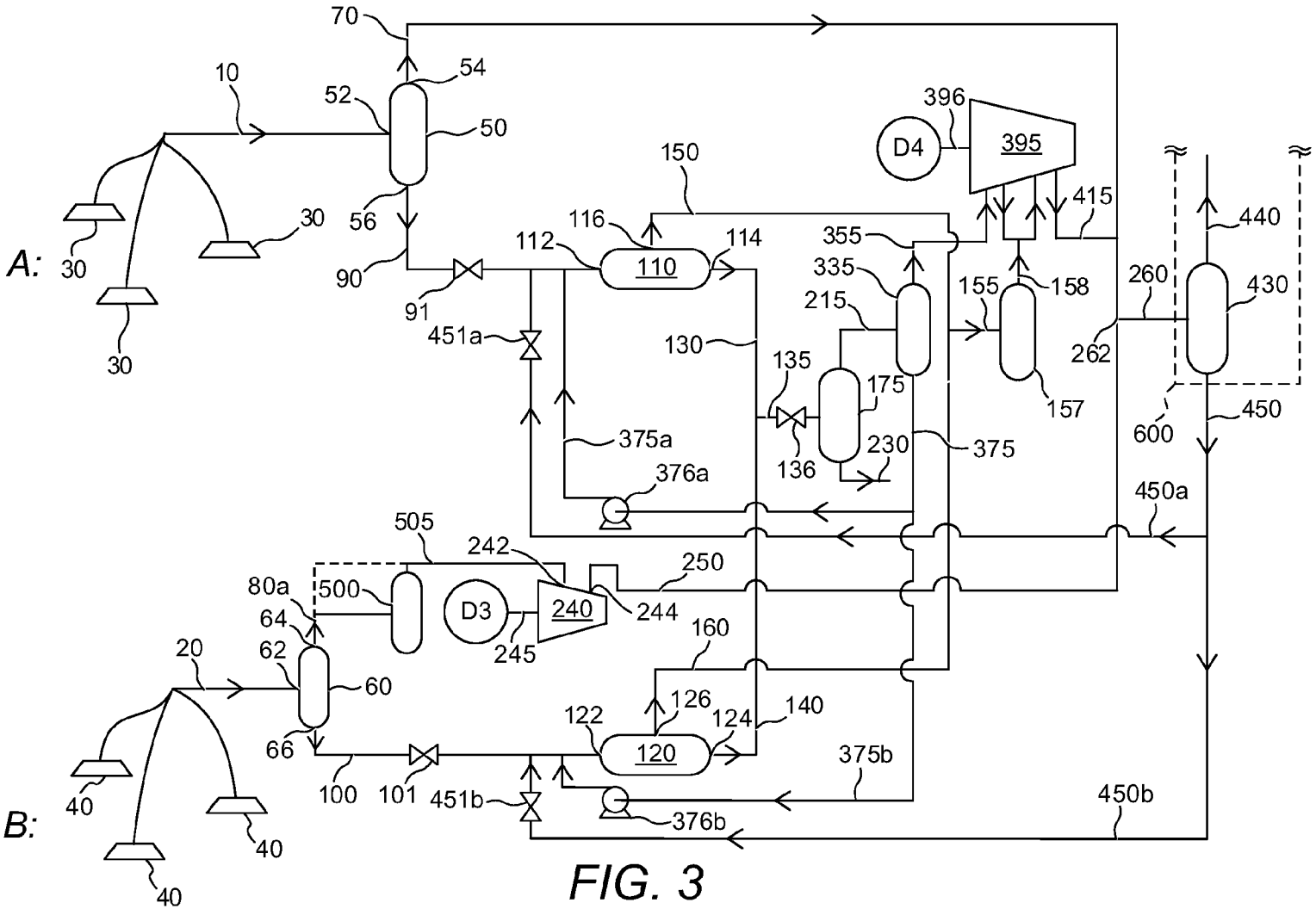
FIG. 3 shows a process scheme according to a third embodiment of the method and apparatus of the invention, in which the second multi-phase hydrocarbon stream is at a lower pressure than the first multi-phase hydrocarbon stream such that the second train comprises a depletion compressor.

FIG. 3 shows an embodiment of the method and apparatus described herein in which the second multi-phase hydrocarbon stream 20 is at a lower pressure compared to the first multi-phase hydrocarbon stream 10. Thus, second multi-phase hydrocarbon stream 20 may be a low pressure second multi-phase hydrocarbon stream 20, and the first multi-phase hydrocarbon stream 10 may be a first high pressure multi-phase hydrocarbon stream 10. In this context, the term "high pressure" is used comparatively to the lower pressure found in the second "low pressure" multi-phase hydrocarbon stream 20.

The first high pressure multi-phase hydrocarbon stream 10 is processed in first inlet separator 50 as described for FIGS. 1 and 2 to provide the first gaseous hydrocarbon component stream 70 overhead, and the first liquid hydrocarbon component stream 90.

The second multi-phase hydrocarbon stream 20, being at a lower pressure than the first multi-phase hydrocarbon stream 10, is passed to a first inlet 62 of the second inlet separator 60, which is operated at a lower pressure than the first inlet separator 50. It provides a second low pressure gaseous hydrocarbon component stream 80*a* overhead at a first outlet 64 and a second liquid hydrocarbon component stream 100 at a second outlet 66.

The second low pressure gaseous hydrocarbon component stream 80*a* will be at a lower pressure than the corresponding first gaseous hydrocarbon component stream 70. The second low pressure gaseous hydrocarbon component stream 80*a* must thus be compressed before it can be combined downstream of trains A and B with the corresponding overhead stream 70 from the first inlet separator 50. The second low pressure gaseous hydrocarbon component stream 80*a* is thus passed either directly to the inlet 242 of second depletion compressor 240 (via the dotted line), or via a second depletion compressor knock out drum 500, which provides a second depletion compressor overhead gaseous stream 505 to the inlet 242 of the second depletion compressor 240.

The second depletion compressor 240 is driven by depletion compressor driver D3 via depletion compressor shaft 245. The second depletion compressor 240 provides a compressed second gaseous hydrocarbon stream 250 at a first outlet 244, which is at substantially the same pressure as the first gaseous (e.g. high pressure) component hydrocarbon stream 70. The compressed second gaseous hydrocarbon stream 250 can thus be combined with the first gaseous (e.g. high pressure) component stream 70 to provide combined gaseous component hydrocarbon stream 260, which can be passed to feed separator as described for FIGS. 1 and 2.

Suitably, the second depletion compressor 240 is capable of handling a suction pressure of as low as 30 bara. This extends the acceptable pressure range for the second multi-phase hydrocarbon stream 20 to down to 35 bara. Suitably as is common I depletion compression units, the control scheme of the second depletion compressor 240 is based on fixed speed drive and (excessive) suction throttling (not shown) to a constant suction pressure of e.g. 30 bara.

The embodiment of FIG. 3 also provides still an alternative line-up for treating the first and second condensate component feed streams 130, 140 and first and first and second overhead gaseous hydrocarbon streams 150, 160. In particular, in a similar manner to the embodiment of FIG. 2 the first and second condensate component feed streams 130, 140 are combined to provide combined condensate component feed stream 135. Combined condensate component feed stream 135 is passed to a combined condensate stabiliser 175, which is of sufficient size to process the combined output of both the first low pressure separators 110, 120. A single valve 136 may be provided in the combined condensate component feed stream line 135, as shown in FIG. 3, and/or valves in each of the first and second condensate component feed stream lines 130, 140.

The combined condensate stabiliser 175 provides a combined condensate component stream 230 at or near the bottom of the stabiliser and a combined condensate separated gaseous hydrocarbon stream 215. The combined condensate separated gaseous hydrocarbon stream 215 is passed to a combined compressor knock out drum 335, to separate any liquid components and provide a combined compressor feed stream 355 as an overhead gaseous stream and a combined separator recycle stream 375, at or near the bottom of the combined compressor knock out drum, which is returned as part streams 375*a*, 375*b* to one or both of the first and second low pressure separators 110, 120, preferably with the aid of one or more pumps 376*a*, 376*b*, and for instance by injection into the first and/or second liquid hydrocarbon component streams 90, 100.

The combined compressor feed stream 355 is passed to a combined compressor 395, driven by first compressor driver D4 and via combined shaft 396. Preferably the combined compressor feed stream 355 is passed to the low pressure stage of combined compressor 395 to provide combined compressed stream 415. The combined compressor 395 may be a multi-stage compressor as disclosed hereinabove for the first and second compressors 390, 400. Combined compressed stream 415 can be injected into the first gaseous hydrocarbon component stream 70 from the first inlet separator 50, or the compressed second gaseous hydrocarbon stream 250 from the second depletion compressor 240, or the combined stream 260 downstream of the trains A and B.

Returning to the first low pressure separator 110, the first overhead gaseous hydrocarbon stream 150 can be combined with the second overhead gaseous hydrocarbon stream 160 from the second low pressure separator 120, to provide a combined overhead gaseous hydrocarbon stream 155. The combined gaseous overhead hydrocarbon stream 155 is passed to a combined overhead knock out drum 157, to separate any liquid components and provide a combined intermediate pressure feed stream 158 as an overhead gaseous stream. The combined intermediate pressure feed stream 158 is passed to the intermediate pressure stage of the combined compressor 395 to provide a portion of the combined compressed stream 415. Any liquid components may be withdrawn from the combined overhead knock out drum 157 as a bottoms stream (not shown) and returned to one or both of the first and second liquid hydrocarbon component streams 90, 100.

In this way, the embodiment shown in FIG. 3 provides a combined gaseous hydrocarbon component stream 260, and combined condensate component stream 230 from first and second trains which differ structurally. In particular, only the second train B, requires the presence of a second depletion compressor 240 because the second multi-phase hydrocarbon stream 20 is at a lower pressure than the first multi-phase hydrocarbon stream 10. The first train A will have no first depletion compressor, because the first gaseous hydrocarbon component stream 70 is already at a high pressure compared to the second low pressure gaseous hydrocarbon component stream 80*a*. The first and second train A, B can utilise the same, different, or no flow assurance methods.

Thus, with regard to the second aspect discussed above, the embodiment of FIG. 3 provides that said first pipeline 10 is for a first high pressure multi-phase hydrocarbon stream 10 and said first inlet separator is a first inlet separator 50 having a first outlet 54 for the first gaseous hydrocarbon component stream 70 and a second outlet 56 for the first liquid hydrocarbon component stream 90; said second pipeline 20 is for a second low pressure multi-phase hydrocarbon stream 20 and said second inlet separator, having a first outlet 64 for the second gaseous hydrocarbon component stream 80 and a second outlet 66 for the second liquid hydrocarbon component stream 100, is operated at a lower pressure than the first inlet separator 50, wherein said first outlet 64 of the second low pressure inlet separator 60 being in fluid communication with the first inlet 242 of a first depletion compressor 240, optionally via a first depletion compressor knock-out drum 500; said first depletion compressor 240 having a first outlet 244 connected to the inlet 262 of a combined gaseous hydrocarbon component stream line 260, said inlet 262 also being connected to the first outlet 54 of the inlet separator 50; and, said second outlet 66 of the second inlet separator 60 is connected to the first inlet 122 of a second low pressure separator 120, said second low pressure separator 120 having a first outlet 124 for a first condensate component feed stream 140, and a second outlet 126 for a first overhead gaseous hydrocarbon stream 150.

Figure 4:
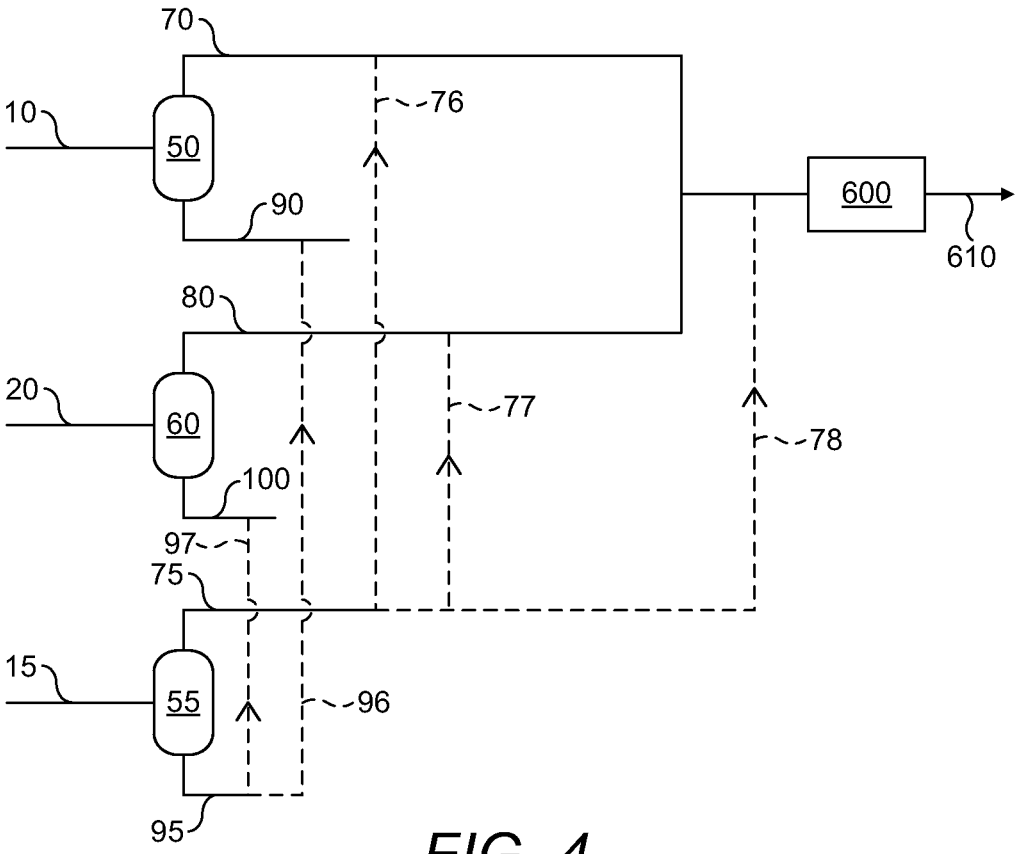
FIG. 4 shows a process scheme according to an embodiment of the invention employing a third inlet separator.

A further embodiment is illustrated in FIG. 4. FIG. 4 shows trains A and B represented in simplified form by the first and second pipelines 10, 20 (containing first and second multi-phase hydrocarbon streams), first and second inlet separators 50, 60, first and second gaseous hydrocarbon component streams 70, 80, and first and second liquid hydrocarbon components streams 90, 100. In addition, a third inlet separator 55 is provided, to receive a third multi-phase hydrocarbon stream 15, which may be the first or second multi-phase hydrocarbon streams 10, 20 as discussed above, or a different third multi-phase hydrocarbon stream. The third inlet separator 55 separates the gaseous and liquid components from the third multi-phase hydrocarbon stream 15 to provide a third gaseous hydrocarbon component stream 75 and a third liquid hydrocarbon component stream 95.

The third gaseous component hydrocarbon stream 75 may be passed to one or more of the group consisting of: the first gaseous hydrocarbon component stream 70 (via optional line 76), the second gaseous hydrocarbon component stream 80 (via the optional line 77) and the combined gaseous component stream 260 (via the optional line 78). Likewise, the third liquid component hydrocarbon stream 95 may be passed to one or more of the group consisting of the first liquid hydrocarbon component stream 90 (via optional line 96) and the second liquid hydrocarbon component stream 100 (via optional line 97).

For instance, a hydrate inhibitor such as a glycol could be injected into a multi-phase hydrocarbon stream to inhibit hydrate formation at the inlet separator of the processing facility. However, high inlet temperatures at the inlet separator may be achieved at full production. Under such circumstances, the third inlet separator could be brought on-line to route the third gaseous component hydrocarbon stream to one or both of the first and second gaseous component hydrocarbon streams.

The third inlet separator 55 may also be used as a test separator.

FIG. 4 also shows that the combined gaseous component hydrocarbon stream 260 may be further processed in a gas processing plant 600 to produce a liquefied hydrocarbon stream 610 (e.g. liquefied natural gas) from the combined gaseous component hydrocarbon stream 260. The further processing may include removal of components from the combined gaseous hydrocarbon component stream 260 that need not be liquefied, such as acid-gas removal, mercury removal, dehydration, natural gas liquids removal of/from the combined gaseous component stream, and heat exchanging against one or more external or internal refrigerants to cool the combined gaseous component stream down to below its bubble point. Many processes for liquefying natural gas known to the person skilled in the art may be used, and will not be further explained here.

The method and apparatus disclosed herein is particularly suited to the Floating Production Storage and Offloading (FPSO) and Floating Liquefaction of Natural Gas (FLNG) concepts. Such concepts combine the intake of oil or natural gas as produced from a well, the oil or natural gas treatment, any liquefaction process, storage tanks, loading systems and other infrastructure onto a single floating structure. Such a structure is advantageous because it provides an off-shore alternative to on-shore processing and liquefaction plants. A FLNG barge can be moored close to or at an oil or gas field, in waters deep enough to allow off-loading of the products onto a transport carrier vessel. The multi-phase streams 10, 20 as discussed above with reference to the Figures may both be produced as subsea wells, and enter onto the off-shore structure at the sea's surface via a single turret. The offshore structure may particularly be positioned very close to one group of wells, which may feed into one of the multi-phase pipe lines (e.g. line 20 of train B), and at the same time take in another multi-phase hydrocarbon stream produced from a well or a group of wells located further away and e.g. requiring a flow assurance method different from the other multi-phase pipe. The invention makes it possible to apply differing flow assurance methods or operating conditions to each of the groups of wells.

Valves employed in the embodiments of the invention above are shown as an example of a pressure reducing device. The skilled person will understand that one or more of the valves may be replaced by or supplemented by any type of pressure reducing devices.

Compressor drivers employed in the embodiments of the invention above may be of any suitable type, including but not limited to an electric motor, a gas turbine or a steam turbine or combinations thereof.

Combiners or splitters employed in the embodiments of the invention above may be of any suitable type, such as T-junctions.

The person skilled in the art will understand that the present invention can be carried out in many various ways without departing from the scope of the appended claims.

We claim:

1. A method of producing a combined gaseous hydrocarbon component stream and liquid hydrocarbon component streams from at least two multi-phase hydrocarbon streams, comprising at least the steps of:

(1) employing a first train comprising a first pipeline for the first multi-phase hydrocarbon stream from one or more first hydrocarbon wells, a first inlet separator to separate the first multi-phase hydrocarbon stream to provide a first gaseous hydrocarbon component stream and a first liquid hydrocarbon component stream and a first low pressure separator to separate the first liquid hydrocarbon component stream to provide a first condensate component feed stream and a first overhead gaseous hydrocarbon stream;

(2) employing a second train comprising a second pipeline for the second multi-phase hydrocarbon stream from one or more second hydrocarbon wells, a second inlet separator to separate the second multi-phase hydrocarbon stream to provide a second gaseous hydrocarbon component stream and a second liquid hydrocarbon component stream and a second low pressure separator to separate the second liquid hydrocarbon component stream to provide a second condensate component feed stream and a second overhead gaseous hydrocarbon stream; and (3) combining the second gaseous hydrocarbon stream downstream of the second train with the first gaseous hydrocarbon stream downstream of the first train to provide a combined gaseous hydrocarbon component stream; wherein first train is structurally different from the second train such that the first and second trains have different operating conditions;

wherein the structural difference between the first and second trains resides in the presence of at least one of the following distinguishing characteristics present in one of the first and the second trains: a depletion compressor to compress the first or second gaseous hydrocarbon stream; one or both of insulation and heating units in the first or second pipelines; and a hydrate inhibition handling unit.

2. The method according to claim 1 in which the at least one distinguishing characteristics that is present in one of the first and second trains, is absent from the other of the first and second trains.

3. The method according to claim 2, wherein:

the employing of the first train in step (1) comprises:

(a) passing the first multi-phase hydrocarbon stream from one or more first hydrocarbon wells along the first pipeline;

(b) separating the first multi-phase hydrocarbon stream in the first inlet separator into its gaseous and liquid components to provide the first gaseous hydrocarbon component stream and the first liquid hydrocarbon component stream;

(c) separating the first liquid hydrocarbon component stream at a lower pressure in the first low pressure separator to provide the first condensate component feed stream and the first overhead gaseous hydrocarbon stream;

and the employing of the second train in step (2) comprises:

(d) passing the second multi-phase hydrocarbon stream from one or more second hydrocarbon wells along the second pipeline;

(e) separating the second multi-phase hydrocarbon stream in the second inlet separator into its gaseous and liquid components to provide the second gaseous hydrocarbon component stream and the second liquid hydrocarbon component stream;

(f) separating the second liquid hydrocarbon component stream at a lower pressure in the second low pressure separator into its gaseous and liquid components to provide the second condensate component feed stream and the second overhead gaseous hydrocarbon stream.

4. A method of producing a combined gaseous hydrocarbon component stream and liquid hydrocarbon component streams from at least two multi-phase hydrocarbon streams, comprising at least the steps of:

(1) employing a first train comprising a first pipeline for the first multi-phase hydrocarbon stream from one or more first hydrocarbon wells, a first inlet separator to separate the first multi-phase hydrocarbon stream to provide a first gaseous hydrocarbon component stream and a first liquid hydrocarbon component stream and a first low pressure separator to separate the first liquid hydrocarbon component stream to provide a first condensate component feed stream and a first overhead gaseous hydrocarbon stream;

(2) employing a second train comprising a second pipeline for the second multi-phase hydrocarbon stream from one or more second hydrocarbon wells, a second inlet separator to separate the second multi-phase hydrocarbon stream to provide a second gaseous hydrocarbon component stream and a second liquid hydrocarbon component stream and a second low pressure separator to separate the second liquid hydrocarbon component stream to provide a second condensate component feed stream and a second overhead gaseous hydrocarbon stream; and (3) combining the second gaseous hydrocarbon stream downstream of the second train with the first gaseous hydrocarbon stream downstream of the first train to provide a combined gaseous hydrocarbon component stream; wherein first train is structurally different from the second train such that the first and second trains have different operating conditions;

wherein the first train is operated under a first flow assurance method and the second train is not operated under the first flow assurance method.

5. The method according to claim 4, wherein the first flow assurance method for the first hydrocarbon stream inhibits hydrate formation and is selected from at least of the group consisting of:

(i) injecting a hydrate inhibitor into the first multi-phase hydrocarbon stream at or before the first multi-phase hydrocarbon stream from the one or more first hydrocarbon wells is passed along the first pipeline;

(ii) insulating the first pipeline with an insulating unit; and (iii) heating the first pipeline with a heating unit.

6. The method according to claim 5, wherein in flow assurance method (i) the hydrate inhibitor is selected from at least one of the group consisting of: thermodynamic inhibitors kinetic inhibitors; and anti-agglomerants.

7. The method according to claim 5, wherein in flow assurance method (i) the hydrate inhibitor comprises a thermodynamic inhibiters selected from one or both of the group consisting of alcohols and glycols.

8. A method of producing a combined gaseous hydrocarbon component stream and liquid hydrocarbon component streams from at least two multi-phase hydrocarbon streams, comprising at least the steps of:

(1) employing a first train comprising a first pipeline for the first multi-phase hydrocarbon stream from one or more first hydrocarbon wells, a first inlet separator to separate the first multi-phase hydrocarbon stream to provide a first gaseous hydrocarbon component stream and a first liquid hydrocarbon component stream and a first low pressure separator to separate the first liquid hydrocarbon component stream to provide a first condensate component feed stream and a first overhead gaseous hydrocarbon stream;

(2) employing a second train comprising a second pipeline for the second multi-phase hydrocarbon stream from one or more second hydrocarbon wells, a second inlet separator to separate the second multi-phase hydrocarbon stream to provide a second gaseous hydrocarbon component stream and a second liquid hydrocarbon component stream and a second low pressure separator to separate the second liquid hydrocarbon component stream to provide a second condensate component feed stream and a second overhead gaseous hydrocarbon stream; and (3) combining the second gaseous hydrocarbon stream downstream of the second train with the first gaseous hydrocarbon stream downstream of the first train to provide a combined gaseous hydrocarbon component stream; wherein first train is structurally different from the second train such that the first and second trains have different operating conditions;

wherein the separation in the first low pressure separator in the first train further provides a first water component stream, and said method further comprises the step of:

(g) treating the first water component stream in a water treatment unit to provide a water stream.

9. A method of producing a combined gaseous hydrocarbon component stream and liquid hydrocarbon component streams from at least two multi-phase hydrocarbon streams, comprising at least the steps of:

(1) employing a first train comprising a first pipeline for the first multi-phase hydrocarbon stream from one or more first hydrocarbon wells, a first inlet separator to separate the first multi-phase hydrocarbon stream to provide a first gaseous hydrocarbon component stream and a first liquid hydrocarbon component stream and a first low pressure separator to separate the first liquid hydrocarbon component stream to provide a first condensate component feed stream and a first overhead gaseous hydrocarbon stream;

(2) employing a second train comprising a second pipeline for the second multi-phase hydrocarbon stream from one or more second hydrocarbon wells, a second inlet separator to separate the second multi-phase hydrocarbon stream to provide a second gaseous hydrocarbon component stream and a second liquid hydrocarbon component stream and a second low pressure separator to separate the second liquid hydrocarbon component stream to provide a second condensate component feed stream and a second overhead gaseous hydrocarbon stream; and (3) combining the second gaseous hydrocarbon stream downstream of the second train with the first gaseous hydrocarbon stream downstream of the first train to provide a combined gaseous hydrocarbon component stream; wherein first train is structurally different from the second train such that the first and second trains have different operating conditions;

wherein the first multi-phase hydrocarbon stream is a first hydrate-inhibited multi-phase hydrocarbon stream comprising a hydrate inhibitor, and wherein the separation in the first low pressure separator in the first train further provides a first spent hydrate inhibitor stream.

10. The method according to claim 9, further comprising the step of:

(h) treating the first spent hydrate inhibitor stream in a regenerating unit to provide a hydrate inhibitor component stream.

11. The method according to claim 10 comprising the further step of: (i) injecting the hydrate inhibitor component stream into at least one of the one or more first hydrocarbon wells.

12. A method of producing a combined gaseous hydrocarbon component stream and liquid hydrocarbon component streams from at least two multi-phase hydrocarbon streams, comprising at least the steps of:

(1) employing a first train comprising a first pipeline for the first multi-phase hydrocarbon stream from one or more first hydrocarbon wells, a first inlet separator to separate the first multi-phase hydrocarbon stream to provide a first gaseous hydrocarbon component stream and a first liquid hydrocarbon component stream and a first low pressure separator to separate the first liquid hydrocarbon component stream to provide a first condensate component feed stream and a first overhead gaseous hydrocarbon stream;

(2) employing a second train comprising a second pipeline for the second multi-phase hydrocarbon stream from one or more second hydrocarbon wells, a second inlet separator to separate the second multi-phase hydrocarbon stream to provide a second gaseous hydrocarbon component stream and a second liquid hydrocarbon component stream and a second low pressure separator to separate the second liquid hydrocarbon component stream to provide a second condensate component feed stream and a second overhead gaseous hydrocarbon stream; and (3) combining the second gaseous hydrocarbon stream downstream of the second train with the first gaseous hydrocarbon stream downstream of the first train to provide a combined gaseous hydrocarbon component stream; wherein first train is structurally different from the second train such that the first and second trains have different operating conditions;

wherein the second multi-phase hydrocarbon stream is a low pressure multi-phase hydrocarbon stream, the first multi-phase hydrocarbon stream is a high pressure multi-phase hydrocarbon stream, and the first inlet separator operated at a higher pressure than the second inlet separator; and said method further comprises the steps of:

(j) compressing the second gaseous component hydrocarbon stream, which is a second low pressure gaseous component hydrocarbon stream, in a depletion compressor to provide a compressed second gaseous hydrocarbon stream; and (k) combining the compressed second gaseous hydrocarbon stream with the first gaseous component hydrocarbon stream, to provide the combined gaseous component hydrocarbon stream.

13. A method of producing a combined gaseous hydrocarbon component stream and liquid hydrocarbon component streams from at least two multi-phase hydrocarbon streams, comprising at least the steps of:

(1) employing a first train comprising a first pipeline for the first multi-phase hydrocarbon stream from one or more first hydrocarbon wells, a first inlet separator to separate the first multi-phase hydrocarbon stream to provide a first gaseous hydrocarbon component stream and a first liquid hydrocarbon component stream and a first low pressure separator to separate the first liquid hydrocarbon component stream to provide a first condensate component feed stream and a first overhead gaseous hydrocarbon stream;

(2) employing a second train comprising a second pipeline for the second multi-phase hydrocarbon stream from one or more second hydrocarbon wells, a second inlet separator to separate the second multi-phase hydrocarbon stream to provide a second gaseous hydrocarbon component stream and a second liquid hydrocarbon component stream and a second low pressure separator to separate the second liquid hydrocarbon component stream to provide a second condensate component feed stream and a second overhead gaseous hydrocarbon stream; and (3) combining the second gaseous hydrocarbon stream downstream of the second train with the first gaseous hydrocarbon stream downstream of the first train to provide a combined gaseous hydrocarbon component stream; wherein first train is structurally different from the second train such that the first and second trains have different operating conditions;

further comprising the steps of:

(l) passing a third multi-phase hydrocarbon stream to a third inlet separator;

(m) separating the third multi-phase stream in the third inlet separator to provide a third gaseous hydrocarbon component stream and a third liquid hydrocarbon component stream;

(n) passing the third gaseous component hydrocarbon stream to at least one of the group consisting of: the first gaseous component stream, the second gaseous component stream, and the combined gaseous component stream; and (o) passing the third liquid component hydrocarbon stream to one or both of: the first liquid hydrocarbon component stream and the second liquid hydrocarbon component stream.

14. A method of producing a combined gaseous hydrocarbon component stream and liquid hydrocarbon component streams from at least two multi-phase hydrocarbon streams, comprising at least the steps of:

(1) employing a first train comprising a first pipeline for the first multi-phase hydrocarbon stream from one or more first hydrocarbon wells, a first inlet separator to separate the first multi-phase hydrocarbon stream to provide a first gaseous hydrocarbon component stream and a first liquid hydrocarbon component stream and a first low pressure separator to separate the first liquid hydrocarbon component stream to provide a first condensate component feed stream and a first overhead gaseous hydrocarbon stream;

(2) employing a second train comprising a second pipeline for the second multi-phase hydrocarbon stream from one or more second hydrocarbon wells, a second inlet separator to separate the second multi-phase hydrocarbon stream to provide a second gaseous hydrocarbon component stream and a second liquid hydrocarbon component stream and a second low pressure separator to separate the second liquid hydrocarbon component stream to provide a second condensate component feed stream and a second overhead gaseous hydrocarbon stream; and (3) combining the second gaseous hydrocarbon stream downstream of the second train with the first gaseous hydrocarbon stream downstream of the first train to provide a combined gaseous hydrocarbon component stream; wherein first train is structurally different from the second train such that the first and second trains have different operating conditions;

wherein the combined gaseous component hydrocarbon stream is further processed to produce a liquefied hydrocarbon stream from the combined gaseous component hydrocarbon stream.

15. The method according to claim 14, wherein the liquefied hydrocarbon stream is a liquefied natural gas stream.

16. An apparatus for producing combined gaseous hydrocarbon and liquid hydrocarbon component streams from at least two multi-phase hydrocarbon streams, said apparatus comprising:

a first train comprising a first pipeline, for a first multi-phase hydrocarbon stream connected to a first inlet of a first inlet separator, said first inlet separator having a first outlet for a first gaseous hydrocarbon component stream and a second outlet for a first liquid hydrocarbon component stream, said second outlet connected to the first inlet of a first low pressure separator, said first low pressure separator having a first outlet for a first condensate component feed stream, a second outlet for a first overhead gaseous hydrocarbon stream; and a second train comprising a second pipeline for a second multi-phase hydrocarbon stream connected to the first inlet of a second inlet separator, said second inlet separator having a first outlet for a second gaseous hydrocarbon component stream and a second outlet for a second liquid hydrocarbon component stream, said second outlet connected to the first inlet of a second low pressure separator, said second low pressure separator having a first outlet for a second condensate component feed stream, a second outlet for a second overhead gaseous hydrocarbon stream; and wherein the first outlet of the second inlet separator and the first outlet of the first inlet separator are fluidly connected downstream of the first and second trains to provide a combined gaseous hydrocarbon component stream line and wherein the first train is structurally different from the second train such that the first and second trains during operation have different operating conditions;

wherein the structural difference between the first and second trains resides in the presence of one or more of the following distinguishing characteristics present in the first and/or or the second train:

a depletion compressor to compress the first or second gaseous hydrocarbon stream;

one or both of insulation and heating units in the first or second pipelines; and a hydrate inhibition handling unit.

17. The apparatus according to claim 16, in which the one or more distinguishing characteristics which are present in one of the first and second trains, is/are absent from the other of the first and second trains.

* * * * *